US005159194A

United States Patent [19]

Marriott et al.

[11] Patent Number: 5,159,194

[45] Date of Patent: Oct. 27, 1992

[54] METHOD AND APPARATUS FOR MASS SPECTROMETRY

[75] Inventors: Philip Marriott, Macclesfield; Anthony M. Jones, Nantwych; Robert S. Taylor, Macclesfield, all of England

[73] Assignees: VG Instruments Group Limited; Fisons Instruments, Uxbridge, England

[21] Appl. No.: 756,290

[22] Filed: Sep. 6, 1991

[30] Foreign Application Priority Data

Sep. 7, 1990 [GB] United Kingdom ..... 9019560

[51] Int. Cl.[5] ..... H01J 49/30

[52] U.S. Cl. ..... 250/298; 250/294; 250/295; 250/296

[58] Field of Search ..... 250/298, 296, 299, 294, 250/295

[56] References Cited

U.S. PATENT DOCUMENTS 3,689,764 9/1972 Green et al. ..... 250/296
3,870,881 3/1975 Halliday et al. ..... 250/296
4,066,895 1/1978 Iwanaga ..... 250/296
4,171,482 10/1979 Vastel ..... 250/296
4,672,204 6/1987 Slodzian et al. ..... 250/296
4,785,172 11/1988 Kubena et al. ..... 250/299

*Primary Examiner*—Jack I. Berman
*Assistant Examiner*—Kiet T. Nguyen
*Attorney, Agent, or Firm*—Chilton, Alix & Van Kirk

[57] ABSTRACT

A method of mass spectrometry and a mass spectrometer for the analysis of a sample, the mass spectrometer comprising means for producing ions from the sample and a magnetic sector for analyzing the ions, wherein the magnetic field of the magnetic sector is generated by passage of a magnet current controlled by a digital control signal representative of a sequence of integers generated by a computer. According to the invention, means are provided for generating the magnet current in exponential relation to the sequence of integers. In contrast to prior spectrometers, the invention provides peak switching and mass selection across the mass range with a constant number of integer steps per mass peak, thereby facilitating the digital selection of any particular mass peak, particularly those at low mass.

17 Claims, 2 Drawing Sheets

METHOD AND APPARATUS FOR MASS SPECTROMETRY

FIELD OF THE INVENTION

This relates to an improved method and an improved apparatus for the analysis of samples by magnetic sector mass spectrometry.

BACKGROUND OF THE INVENTION

Magnetic sector mass spectrometry comprises in outline ionizing a sample, dispersing the resulting sample ions according to their respective masses in a magnetic field, directing and preferably focusing ions in one or more selected mass ranges towards a detector, and detecting the ions as part or all of a mass spectrum. The magnetic field disperses the ions according to the relationship: $m=qr^2B^2/2U$ where: m is the mass of an ion, q is its charge, r is the radius of its trajectory through the field, B is the magnetic induction of the field, and U is a potential difference through which the ions are accelerated before entering the magnetic field. High performance magnetic sector mass spectrometers usually additionally comprise an electric sector for selecting or focusing ions according to their energies. The electric sector may be disposed before or after the magnetic sector on the ion flight path according to the requirements of the analysis.

A spectrum may be recorded by parallel detection, wherein the magnetic field is kept constant and ions of all masses are detected simultaneously by means of a photographic plate, or electronically by a multichannel detector as described in U.S. Pat. No 4785172 for example. While parallel detection is efficient in its use of sample material its performance is limited by such factors as the spatial resolution of the detector array or the sensitivity (and inconvenience) of a photographic plate. Alternatively a spectrum may be recorded serially by varying either the magnetic field strength or the accelerating voltage and detecting ions at a fixed radius. Varying the accelerating voltage gives fast scanning but suffers from a reduction in sensitivity at low voltage which limits its usefulness. Alternative methods of electrostatic scanning are described in U.S. Pat. Nos. 4066895, 4171482 and 4672204.

Often it is preferable to select mass by control of the magnetic field strength. A spectrum may be recorded by scanning the magnetic field from one extreme value to another over a recording time, or alternatively the field may be switched between parts of the spectrum. In scanning mode, since the mass does not vary linearly with field, it is necessary to vary the field in a non-linear manner with time in order to give an equal time recording each peak. This is described for example by D B Wittry in Proceedings 13th Microbeam Analysis Society 1978 pages 11A to 11D, D B Wittry and G Guo in SIMS II, 1980, pages 199 to 201, and C Merritt et al in Analytical Chemistry 1965, volume 37(8), pages 1037 to 1039. Techniques for the peak switching mode of operation are described for example by: N D Young et al in Analytical Chemistry 1975, volume 47(14), pages 2373 to 2376; L W Green et al in the International Journal of Mass Spectrometry and Ion Processes 1985, volume 67, pages 253 to 265; R A Dick in the International Journal of Mass Spectrometry and Ion Physics 1975, volume 18, pages 193 to 198; and P G Oza et al in the Proceedings of the Indian Academy of Science (Chemical Science) 1984, volume 93(2), pages 189 to 193. General introductions to techniques of data acquisition in mass spectrometry are given for example by J R Chapman in Computers in Mass Spectrometry, Academic Press 1978, and by M E Rose and R A W Johnstone in Mass Spectrometry for Chemists and Biochemists, Cambridge University Press 1982.

In typical prior techniques of peak switching the mass peaks are selected by a computer which, operating through a digital to analogue converter (DAC), controls a supply of current to the magnet field coils. The field current is at any instant proportional to an integer which is fed by the computer to the DAC. However, since the peaks at low mass are less wide than peaks at high mass, it is necessary to provide a higher density of integer steps per unit mass at low mass than at high mass in order to give an acceptable number of measurement points when scanning through a peak. Conventionally this is achieved by changes in gain and offset voltage for extending and shifting the mass range covered by the DAC output.

SUMMARY OF THE INVENTION

It is an object of this invention to provide a method of mass spectrometry with improved magnetic sector control, and it is a further object to provide an apparatus for carrying out said method.

According to one aspect the invention provides a method for the mass spectrometric analysis of a sample comprising the steps of producing ions from said sample, mass analyzing said ions by means of a magnetic sector mass analyzer wherein the magnetic field for the selection of ions is generated by the passage of a magnet current, and controlling said magnet current by means of a digital control signal representing a sequence of integers N, said method being characterized by generating said magnet current as an exponential function of said sequence of integers N.

In referring to an exponential function we are not restricted to the choice of base e, base 10 or some other value, we use the term exponential function to cover all of these. Similarly the magnet current may be generated from a power series, or some other function or mathematical routine substantially equivalent to an exponential function.

The sample ions may be produced by any convenient ionizing process, such as by sputtering or other forms of particle bombardment process, or by chemical or photon induced ionization. The method also comprises detecting ions of one or more masses by means of a particle detector. Peaks of different masses may be sequentially detected by generating a sequence of integers and the currents related exponentially thereto. The selected masses are preferably selected statically, that is without continuously sweeping or scanning the field over a period of time.

The term "sequence of integers" refers to a sequential set of numerical values from, for example, a digital control means. Any one of these values may be generated at a particular time. The invention is not restricted to a sequence of numbers separated by increments of the same amount.

Preferably, to select at any particular instant ions of mass M in a spectrum of ions ranging from mass $M_{min}$ to $M_{max}$, the method comprises generating an integer N (i.e. a discrete value of the digital control signal) in a range from $N_{min}$ to $N_{max}$ according to:

$$N = N_{min} + (N_{max} - N_{min}) \frac{\ln(M/M_{min})}{\ln(M_{max}/M_{min})} \quad (1)$$

Conveniently $N_{min}=0$, giving:

$$N = N_{max} \frac{\ln(M/M_{min})}{\ln(M_{max}/M_{min})} \quad (2)$$

The magnet current I (which lies in a range up to $I_{max}$) is given by an expression of the form:

$$I=k_1 \exp(k_2N-k_3)$$

so that:

$$I = I_{max}\left[\frac{M_{min}}{M_{max}}\right]^{\frac{1}{2}} \exp\left[\frac{(N - N_{min})}{2(N_{max} - N_{min})} \ln(M_{max}/M_{min})\right] \quad (3)$$

which implicitly contains the constants $k_1$, $k_2$ and $k_3$. Conveniently $N_{min}$ is zero, so that:

$$I = I_{max}\left[\frac{M_{min}}{M_{max}}\right]^{\frac{1}{2}} \exp\left[\frac{N}{2\,N_{max}} \ln(M_{max}/M_{min})\right] \quad (4)$$

The method may comprise generating a first analogue electrical signal which at any instant is proportional to current value N of the sequence of integers, transforming that signal to a second electrical signal which is exponentially related to the first signal, and generating the magnet current proportionally to the second signal. Preferably the first electrical signal is a voltage $V_1$ which is proportional to N and lies in a range from from $V_{1,min}$ to $V_{1,max}$, while the second electrical signal is a voltage $V_2$ which lies in a range from $V_{2,min}$ to $V_{2,max}$ and is related to the first electrical signal $V_1$ by an expression of the form:

$$V_2=k_4 \exp(k_5V_1-k_6)$$

so that:

$$V_2 = V_{2,max}\left[\frac{M_{min}}{M_{max}}\right]^{\frac{1}{2}} \exp\left[\frac{(V_1 - V_{1,min})\ln(M_{max}/M_{min})}{2(V_{1,max} - V_{1,min})}\right] \quad (5)$$

which implicitly contains the constants $k_4$, $k_5$ and $k_6$.

In a particularly convenient embodiment $N_{min}$ and $V_{1,min}$ are zero, so that:

$$V_2=k_4 \exp(k_5V_1)$$

and $$V_2 = V_{2,max}\left[\frac{M_{min}}{M_{max}}\right]^{\frac{1}{2}} \exp\left[\frac{V_1}{2\,V_{1,max}} \ln(M_{max}/M_{min})\right] \quad (6)$$

in which case the constants $k_4$, $k_5$ and $k_6$ are:

$$k_4 = V_{2,max}\left[\frac{M_{min}}{M_{max}}\right]^{\frac{1}{2}}, \; k_5 = \frac{\ln(M_{max}/M_{min})}{2\,V_{1,max}}, \; k_6 = O$$

In one preferred embodiment, the signal $V_1$ is generated from the digital control signal by a digital-to-analogue converter (DAC), and an antilogarithmic amplifier is used to generate the signal $V_2$ from $V_1$ according to one of the relationships given above. A current source amplifier is then used to generate the magnet current I from $V_2$.

In an alternative preferred embodiment the method comprises generating a first digital control signal representative of a sequence of integers N, generating a second digital control signal representative of a sequence of integers $N_2$ which are exponentially related to the integers N by the expression $N_2 \alpha f(N)/N$, where f(N) is an exponential function of N; transmitting the first digital control signal to a first digital to analogue conversion means for generating a first voltage signal $V_1$ proportional to the sequence of integers N; transmitting $V_1$ as a reference voltage to a second digital to analogue conversion means; transmitting the second digital control signal to said second digital to analogue conversion means and generating therefrom an output voltage signal $V_{DAC2}$ proportional to $V_1$ and to the second sequence of integers $N_2$; deriving a second voltage signal $V_2$ proportional to $V_{DAC2}$; and generating said magnet current proportionally to $V_2$.

In this embodiment the second DAC acts as an amplifier with an output that cannot exceed $V_1$ but with a gain $V_{DAC2}/V_1$ which can be varied in very small steps from zero to one, according to $V_{DAC2}=V_1N_2/N_{2,max}$. The number $N_{2,max}$ is the maximum number acceptable to the second DAC ie $N_{2,max}=(2^p-1)$ where p is the 'order' of the second DAC. The step of deriving $V_2$ from $V_{DAC2}$ preferably comprises adding an offset voltage to $V_{DAC2}$ to ensure that the magnet current always has a non-zero value and that there is a minimum value for allowing the selection of ions of mass $M_{min}$, nominally 0.9 Daltons. Preferably $V_2=V_{DAC2}+k_4$. Typically $$N_2 = \frac{N_{2,max}\, k_4\, [\exp(k_5\, k\, N) - 1]}{k\, N} \quad (7)$$

where k is the constant of proportionality relating the output of the first DAC to its input, ie $V_1=kN$.

In full:

$$N_2 = \quad (8)$$

$$\frac{N_{2,max}\, V_{2,max}}{k\, N}\left[\frac{M_{min}}{M_{max}}\right]^{\frac{1}{2}}\left[\exp\left[\frac{\ln(M_{max}/M_{min})\, k\, N}{2\, IV_{1,max}} - 1\right]\right]$$

According to another aspect of the invention there is provided a mass spectrometer for the analsysis of a sample comprising means for producing ions from said sample, a magnetic sector for mass analyzing said ions wherein he magnetic field is generated by the passage of a magnet current, and means for generating a digital control signal representative of a sequence of integers for controlling said magnet current, wherein means are provided for generating said magnet current as an exponential function of said sequence of integers.

Preferably, in order to select at any particular instant ions of mass M in a spectrum of ions ranging form $M_{min}$ to $M_{max}$, the means for generating the control signal generates an integer N in the range $N_{min}$ to $N_{max}$ according to:

$$N = N_{min} + (N_{max} - N_{min}) \frac{\ln(M/M_{min})}{\ln(M_{max}/M_{min})} \quad (1)$$

Conveniently, but not essentially, $N_{min}=0$.

In a preferred embodiment the spectrometer comprises a digital to analogue converter (DAC) for receiving the control signal and for producing a first electrical signal in response thereto, means for generating a second electrical signal with a magnitude exponentially related to the first electrical signal, and a current source for generating the magnet current proportionally to the second electrical signal. Preferably the first and second electrical signals are analogue voltages, to be represented respectively herein by the symbols $V_1$ and $V_2$ as introduced above.

In one preferred embodiment the means for generating the second electrical signal comprises an antilogarithmic (exponential) amplifier, acting as a function generator, which produces $V_2$ from $V_1$ substantially according to:

$$V_2 = V_{2,max}\left[\frac{M_{min}}{M_{max}}\right]^{\frac{1}{2}} \times 10^{\left[\frac{V_1}{2V_{1,max}} \cdot \frac{\ln(M_{max}/M_{min})}{\ln(10)}\right]} \quad (9)$$

This expression is functionally equivalent to equation 6. The magnet current I is similarly given as:

$$I = I_{max}\left[\frac{M_{min}}{M_{max}}\right]^{\frac{1}{2}} \times 10^{\left[\frac{N}{2N_{max}} \cdot \frac{\ln(M_{max}/M_{min})}{\ln(10)}\right]} \quad (10)$$

This form of the exponential function is more convenient than the form written in terms of e, due to the availability of suitable electronic components. However the principle is identical in each case, and some other base for the exponent would similarly lie within the scope of the invention. In an alternative preferred embodiment the spectrometer comprises means for generating a first digital control signal representative of a sequence of integers N, means for generating a second digital control signal representative of a second sequence of integers $N_2$ exponentially related to the integers N, a first DAC for receiving the first digital signal and for generating a voltage signal $V_1$ proportional thereto; a second DAC for receiving both the second digital signal and the voltage signal $V_1$, for generating an output voltage signal $V_{DAC2}$ which is substantially proportional to both $N_2$ and $V_1$; and means for generating a voltage signal $V_2$ from $V_{DAC2}$. Preferably the means for generating $V_2$ comprises means for generating and combining an offset voltage with $V_{DAC2}$ to produce $V_2$. Preferably N and $N_2$ are generated by means of a computer according to the equations (1) and (8).

DETAILED DESCRIPTION OF THE INVENTION

Figure 1:
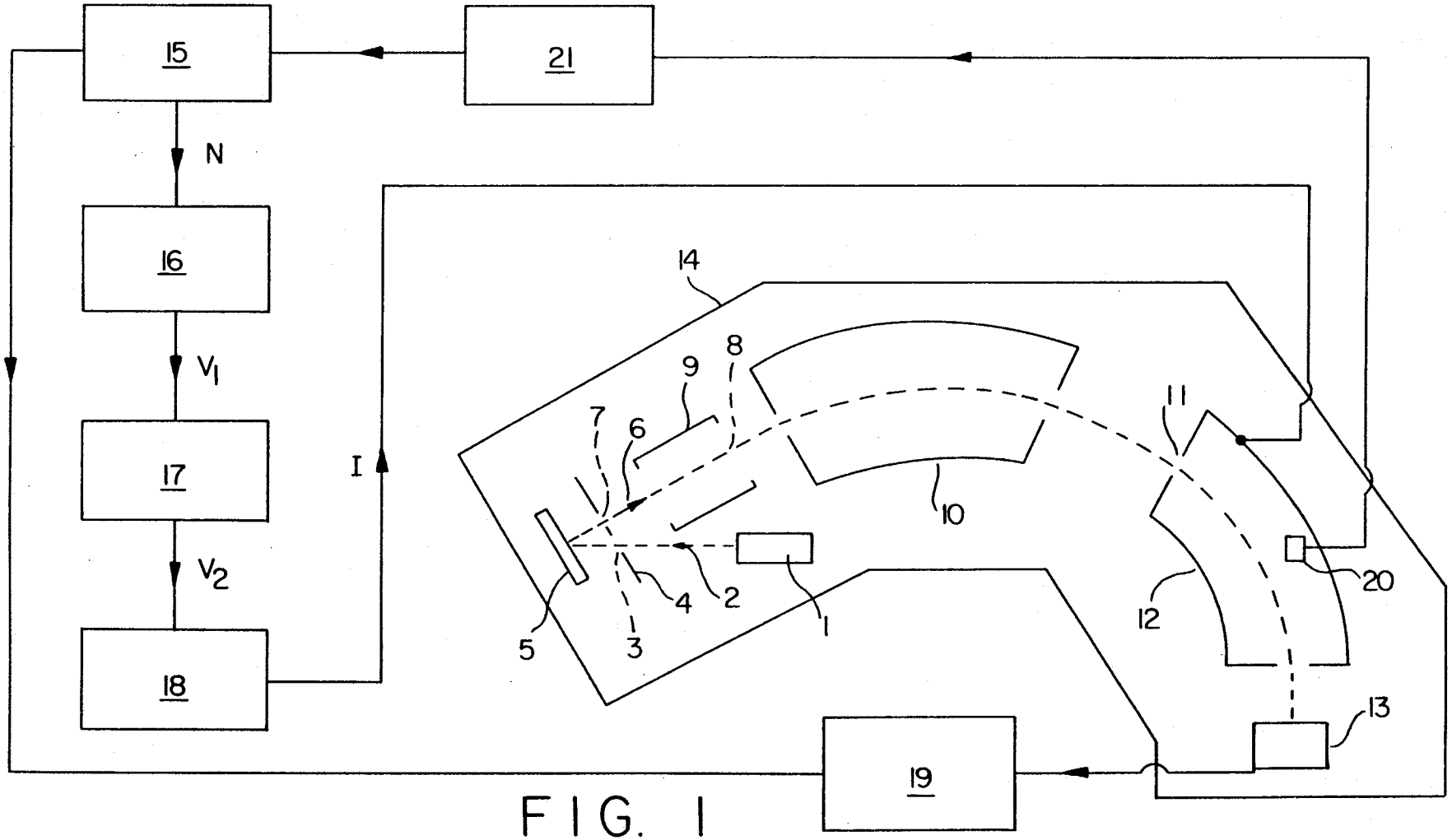
FIG. 1 schematically illustrates a magnetic sector mass spectrometer according to the invention in which the magnet current is generated by means comprising a single digital to analogue converter together with an exponential amplifier.

Referring first to FIG. 1 a magnetic sector mass spectrometer comprises a primary ion source 1 for producing and directing a beam of primary ions 2 through an aperture 3 in an electrode 4 towards a sample 5. The impact of the primary ions 2 causes sample 5 to release sample ions 6 which are accelerated by an extraction potential, maintained between sample 5 and electrode 4, towards an extraction aperture 7 in electrode 4. The ions 6 pass from aperture 7 along and about a spectrometer axis 8 towards transfer optics 9, which directs the ions to an electrostatic sector 10. The sector 10 focuses the ions 6 according to their kinetic energies before transmitting them to an entrance 11 of a magnetic sector analyzer 12. The kinetic energy of ions 6 arriving at an entrance 11 of sector 10 is controlled by an accelerating potential difference $U_a$ maintained between sample 5 and entrance 11. Typically this potential is in a range from 2 kV to 8 kV with the entrance 11 at ground potential. The extraction electrode 4 may be at ground or a controllably variable potential. The magnetic sector analyzer 12 comprises an electromagnet with field coils which generate a field of induction B when energised with a current as will be described. Sample ions entering sector 12 are dispersed by the magnetic field, and ions of substantially equal masses are focused at common points by virtue of the geometry of the sector. Ions of charge q and mass $M=qr^2B^2/2U_a$ are brought to focus at a detector 13, after passing through sector 12 on a trajectory of sector radius r. An electrical signal indicating the number of ions arriving at detector 13 is passed to a data processor 19 which, also receiving a signal from a computer 15 indicative of the selected mass, produces all or part of a mass spectrum.

Additional components of the spectrometer include a Hall probe 20 and an associated controller 21 which may be used to monitor the field in sector 12. The probe 20 is used, for example, to monitor the magnetic field at a set value, to calibrate the mass measurements over a range of values, or for feedback control in certain modes of operation of the spectrometer. The probe is however not essential to the invention. The spectrometer also comprises a vacuum envelope 14 and pumps (not shown) for maintaining high or ultra high vacuum conditions therein. The spectrometer also has power supplies, for example for controlling the ion source 1, the potential of sample 5, transfer optics 9, electrostatic sector 10 and detector 13. The spectrometer may additionally comprise further ion optical elements, although these are not relevant to the invention and are not described herein.

To select a peak of mass M in a spectrum of ions ranging from $M_{min}$ to $M_{max}$, either automatically or at an operator's demand, computer 15 generates a digital control signal representative of an integer N in the range $N_{min}$ to $N_{max}$, where $N_{min}$ is usually zero. The computer generates N according to:

$$N = N_{min} + (N_{max} - N_{min}) \frac{\ln(M/M_{min})}{\ln(M_{max}/M_{min})} \quad (1)$$

$$N = N_{max} \frac{\ln(M/M_{min})}{\ln(M_{max}/M_{min})} \text{ where } N_{min} = 0 \quad (2)$$

The control signal from computer 15 is fed to a digital to analogue converter (DAC) 16 which generates a first voltage signal $V_1$, proportional to N and lying in a range from $V_{1,min}$ (typically 0 V) to $V_{1,max}$ (typically 10 V). The signal $V_1$ is then fed to an antilogarithmic (or exponential) amplifier (or function generator) 17 which generates a second voltage signal $V_2$ in a range from $V_{2,min}$ to $V_{2,max}$ (typically 10 V) and related to $V_1$ by a transfer function:

$$V_2 = V_{2,max}\left[\frac{M_{min}}{M_{max}}\right]^{\frac{1}{2}} \times 10^{\left[\frac{V_1}{2V_{1,max}} \cdot \frac{\ln(M_{max}/M_{min})}{\ln(10)}\right]}$$

The transfer function expression for $V_2$ may alternatively be expressed in terms of base e as $V_2=k_4 \exp(k_5V_1-k_6)$:

$$V_2 - V_{2,max}\left[\frac{M_{min}}{M_{max}}\right]^{\frac{1}{2}} \exp\left[\frac{(V_1 - V_{1,min})\ln(M_{max}/M_{min})}{2(V_{1,max} - V_{1,min})}\right]$$

And, if $V_{1,min}$ is zero:

$$V_2 = V_{2,max}\left[\frac{M_{min}}{M_{max}}\right]^{\frac{1}{2}} \exp\left[\frac{V_1}{2\,V_{1,max}} \ln(M_{max}/M_{min})\right]$$

The invention is not restricted to the particular form of the expressions, and the principle is not dependent on the choice of base e, base 10 or some other value; we use the term exponential function to cover all of these. The choice of base 10 in the practical preferred embodiment is convenient due the availability of electronic components for amplifier 17. Similarly $V_2$ may be generated from a power series, or some other function or mathematical routine (such as use of an electronically stored table or set of values) which is substantially equivalent to the described exponential function. The various electronic components are, in themselves, standard commercially available items operated according to the manufacturer's specifications. For example, the DAC 16 is a Sipex SP9380-18 and the amplifier (function generator) 17 is an Analog Devices AD759P.

Typical mass ranges are 0.9 to 640 Daltons (amu) and 0.9 to 2000 Daltons, as selected by switching between different coil windings on the magnet in magnetic sector analyzer 12. The corresponding transfer functions giving $V_2$ from $V_1$, with the above typical maximum and minimum values for $V_1$ and $V_2$, are then:

$V_2=0.3750\times10^{(0.134V_1)}$ Volts, for 0.9 to 640 Daltons $V_2=0.2121\times10^{(0.167V_1)}$ Volts, for 0.9 to 2000 Daltons The signal $V_2$ is then fed to an amplifier 18 which generates a current I (in a range up to $I_{max}$) which is substantially proportional to $V_2$. The current I then energises magnetic sector 12 to generate a magnetic field for the selection of the ions of mass M as required. Those ions reaching detector 13 are recorded by a data system 19, which also receives the information of the value of M requested from computer 15. In this way one or more peaks may be analysed, and all or part of a spectrum may be recorded by switching from peak to peak if required.

In generating the second signal $V_2$ from the first signal $V_1$ according to the expression given above, and then generating the magnet current I from $V_2$, the method is putting into effect the basic principle of the invention which is to generate the magnet current as an exponential function of the sequence of integers N. Generally the method comprises generating I by an expression of the form $I=K_1 \exp(K_2N-K_3)$ in which $k_1$, $k_2$ and $k_3$ are constants, thus:

$$I = I_{max}\left[\frac{M_{min}}{M_{max}}\right]^{\frac{1}{2}} \exp\left[\frac{(N - N_{min})}{2(N_{max} - N_{min})} \ln(M_{max}/M_{min})\right] \quad (3)$$

And, if $N_{min}$ is zero:

$$I = I_{max}\left[\frac{M_{min}}{M_{max}}\right]^{\frac{1}{2}} \exp\left[\frac{N}{2\,N_{max}} \ln(M_{max}/M_{min})\right] \quad (4)$$

Which in terms of base 10 is:

$$I = I_{max}\left[\frac{M_{min}}{M_{max}}\right]^{\frac{1}{2}} \times 10^{\left[\frac{N}{2N_{max}} \cdot \frac{\ln(M_{max}/M_{min})}{\ln(10)}\right]}$$

Figure 2:
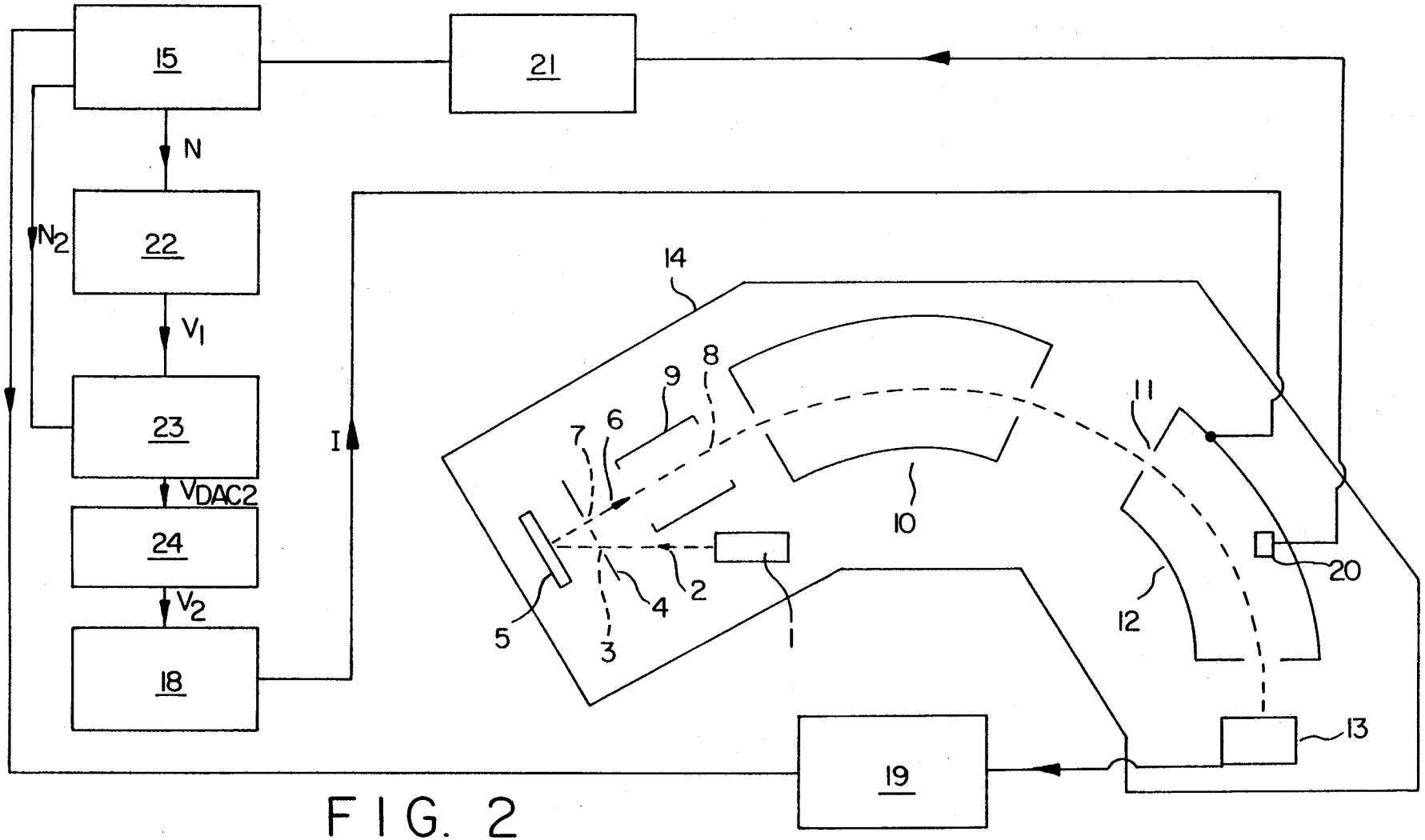
FIG. 2 schematically illustrates a magnetic sector mass spectrometer according to the invention in which the magnet current is generated by means comprising two digital to analogue converters.

Referring next to FIG. 2 there is shown an alternative mass spectrometer according to the invention. The components numbered 1 to 15 and 18 to 21 are substantially the same as for the spectrometer of FIG. 1 and need not be described further (computer 15 here has the additional function of generating a second sequence of integers $N_2$ as will be discussed). Instead of the single DAC 16 and antilogarithmic amplifier 17 the spectrometer of FIG. 2 has a first DAC 22 and a second DAC 23, along with an offset voltage generator 24. Operation of this embodiment of the invention is as follows:

To select an ion of mass M the computer 15 sends a first integer N (in a range from 0 to $N_{max}$) to first DAC 22 with:

$$N = N_{max}\frac{\ln(M/M_{min})}{\ln(M_{max}/M_{min})}$$

The computer also sends a second integer $N_2$ (in a range from 0 to $N_{2,max}$) to second DAC 23. The first DAC 22 produces an output voltage $V_1$ which is proportional to N, ie $V_1=kN$, where k is set electronically. That voltage $V_1$ is then transmitted to second DAC 23 where it limits the output $V_{DAC2}$ of DAC 23 according to the relation $V_{DAC2}=(N_2/N_{2,max})V_1$. Hence the second DAC 23 acts as an amplifier with a maximum output of $V_1$ and with gain varying according $N_2$. The voltage $V_{DAC2}$ is passed to voltage generator 24 which adds an offset voltage to produce $V_2=V_{DAC2}+K_4$, so that there is a finite minimum magnet current corresponding to mass $M_{min}$. The constant $K_4$ is given by $K_4=V_{2,max}\sqrt{(M_{min}/M_{max})}$.

To summarise:

$V_2 = V_{DAC2} + k_4$ gives:

$$V_2 = \frac{N_2\,k\,N}{N_{2,max}} + V_{2,max}\left[\frac{M_{min}}{M_{max}}\right]^{\frac{1}{2}}$$

Which rearranged gives $N_2$ as:

$$N_2 = \frac{N_{2,max}}{k\,N}\left[V_2 - V_{2,max}\left[\frac{M_{min}}{M_{max}}\right]^{\frac{1}{2}}\right]$$

$V_2$ is given by equation 6 as $V_2 = K_4 \exp(k_5 V_1)$, so:

$$N_2 = \frac{N_{2,max}\,V_{2,max}}{k\,N}\left[\frac{M_{min}}{M_{max}}\right]^{\frac{1}{2}}\left[\exp\left[\frac{\ln(M_{max}/M_{min})\,k\,N}{2\,V_{1,max}} - 1\right]\right]$$

By generating N and $N_2$ according to the expressions given above (or according to expressions or by routines which are substantially equivalent thereto), and then generating $V_2$ and the current I therefrom as described, this embodiment also gives $V_2$ and I as substantially exponential functions of the sequence of integers N. In the above, the DACs 22 and 23 are standard commercially available components, typically we use Sipex SP9380-18 operated generally according to the manufacturer's specifications, except that we vary the reference voltage $V_1$ where other applications may employ a fixed reference voltage. The offset amplifier 24 is an Analog Devices AD707CQ. Advantages of the invention may be illustrated by considering the resolution of a spectrometer built and operated according to its principles. The resolution R is conventionally defined as the ratio $R = M/\Delta M$, where a peak of mass M is considered to be resolved from its neighbor of the same height at mass $M + \Delta M$ when the peak height where they overlap is equal to 10% of the height of the peaks. This is commonly referred to as the 10% valley definition. A magnetic sector mass spectrometer has constant resolution across the mass range, ie the peak width is proportional to the mass of the peak. However, because the selected mass is not linearly related to magnet current, in a conventional spectrometer peaks at low mass are scanned by fewer given increments in magnet current than those at higher mass. In the present invention, the step in mass dM is made to vary with mass to give a constant number of mass steps per peak across the mass range. So, dM/dN is proportional to M, which we implement as $dM/dN = M/R$ where R is the ultimate resolution limited only by the size of the DAC steps (the difference in output voltage corresponding the minimum change in the integer input to the DAC). Thus according to our invention $R = M/(dM/dN)$ or $R = (M/dM).dN$. To evaluate M/dM, consider that M is proportional to the square of the magnetic induction B, and hence to the square of the current I. Thus $M = aI^2$, where a is a constant factor, and hence $dM = 2aI.dI$ which by division gives $M/dM = I/(2.dI)$. The change dI in I corresponding to dN is obtained by differentiating equation 3 as:

$$dI = \frac{\ln(M_{max}/M_{min}) \cdot I \cdot dN}{2(M_{max} - N_{min})}$$

$$\text{Thus: } \frac{M}{dM} = \frac{I}{2 \cdot dI} = \frac{N_{max} - N_{min}}{\ln(M_{max}/M_{min}) \cdot dN}$$

$$\text{And: } R = \frac{M}{dM} \cdot dN = \frac{N_{max} - N_{min}}{\ln(M_{max}/M_{min})}$$

The number $N_{max}$ is determined by the highest number p of bits acceptable by the DAC. Then $N_{max} = 2^P - 1 \approx 2^P$ and, since $N_{min}$ is preferably zero, the resolution is given by $R = (2^P - 1)/\ln(M_{max}/M_{min})$. So, while the resolution depends upon the extent of the mass range, it is independent of the selected mass. Usually it is arranged that there be more than one DAC step across the width of a peak, in which case the expression M/dM represents the number of DAC steps per peak, which again is constant across the mass range. This is a significant advantage over certain prior spectrometers which, while employing digital control, select the current I as directly proportional to N. Then the mass M is proportional to $N^2$, and M/dM varies as $\sqrt{M}$. The present invention uniquely provides peak switching and mass selection across the mass range with constant resolution and a constant number of DAC steps per mass peak. The selected masses are selected substantially statically, that is without sweeping or scanning the magnet field over time. With an 18-bit DAC typical values of resolution R are approximately 40000 for a mass range from 0.9 to 640 Daltons, and approximately 34000 for a mass range from 0.9 to 2000 Daltons.

In producing the sample ions by primary ion bombardment the described examples are particularly suitable for analyzing the surface regions of solid samples by the technique known as secondary ion mass spectrometry (SIMS). However the invention is not restricted to SIMS or other surface analyzers and may also apply in spectrometers with alternative means for producing sample ions. Thus the invention may equally be applied in spectrometers for the analysis of gaseous, liquid or solid samples in which sample ions are produced by electron, thermal, chemical or photon induced ionization. Similarly the invention may be applied to other analyzer geometries such as the spectrometer described by D Schuetzle et al in the Review of Scientific Instruments 1989, volume 60(1), pages 53 to 64 in which the magnetic sector and electric sector are in 'reverse order geometry' compared with the illustrated examples. The invention is applicable wherever a magnetic sector analyzer is used in mass spectrometry.

What is claimed is:

1. A method for the mass spectrometric analysis of a sample comprising the steps of producing ions from said sample, mass analyzing said ions by means of a magnetic sector mass analyzer wherein the magnetic field for the selection of ions is generated by the passage of a magnet current, and controlling said magnet current by means of a digital control signal representing a sequence of integers N, said method being characterized by generating said magnet current as an exponential function of said sequence of integers N.

2. A method as claimed in claim 1 wherein at a particular instant ions of mass M in a spectrum of ions ranging from mass $M_{min}$ to $M_{max}$ are selected by generating an integer N in a range from $N_{min}$ to $N_{max}$ where:

$$N = N_{min} + (N_{max} - N_{min})\frac{\ln(M/M_{min})}{\ln(M_{max}/M_{min})}.$$

3. A method as claimed in claim 1 wherein the step of generating said magnet current comprises providing a first voltage signal $V_1$ in the range $V_{1,min}$ to $V_{1,max}$ proportional to said sequence of integers N, providing a second voltage signal $V_2$ in the range $V_{2,min}$ to $V_{2,max}$, and producing a said magnet current I which is substantially proportional to $V_2$; wherein the second voltage signal $V_2$ is related to the first voltage signal $V_1$ by the expression:

$$V_2 = V_{2,max}\left[\frac{M_{min}}{M_{max}}\right]^{\frac{1}{2}} \exp\left[\frac{(V_1 - V_{1,min})\ln(M_{max}/M_{min})}{2(V_{1,max} - V_{1,min})}\right].$$

4. A method as claimed in claim 1 wherein the step of generating said magnet current comprises providing a first digital control signal representative of a sequence of integers N, providing a second digital control signal representative of a sequence of integers $N_2$ which are exponentially related to the integers N by the expression $N_2 \alpha f(N)/N$, where f(N) is an exponential function of N; transmitting the first digital control signal to a first digital to analogue conversion means for generating a first voltage signal $V_1$ which is proportional to the sequence of integers N; transmitting voltage signal $V_1$ as a reference voltage to a second digital to analogue conversion means; transmitting the second digital control signal to said second digital to analogue conversion means and generating from said reference voltage and second digital control signal an output voltage signal $V_{DAC2}$ proportionally to $V_1$ and to the second sequence of integers $N_2$; deriving a second voltage signal $V_2$ which is proportional to $V_{DAC2}$; and to producing a said magnet current which is proportional to $V_2$.

5. A method as claimed in claim 4 wherein:

$$V_2 = \frac{N_2 \cdot V_1}{N_{2,max}} + V_{2,max}\left[\frac{M_{min}}{M_{max}}\right]^{\frac{1}{2}}.$$

6. A method as claimed in claim 4 in which said second integers $N_2$are related to said first integers N by an expression of the form:

$$N_2 = \frac{N_{2,max}\, V_{2,max}}{k\,N}\left[\frac{M_{min}}{M_{max}}\right]^{\frac{1}{2}}\left[\exp\left[\frac{\ln(M_{max}/M_{min})\, k\, N}{2\, V_{1,max}} - 1\right]\right]$$

wherein k is a constant defined by $V_1 = kN$.

7. A method as claimed in claim 1 further comprising sequentially detecting a plurality of mass peaks by generating a sequence of integers and generating therefrom a corresponding sequence of discrete values of magnet current so that each of said plurality of mass peaks is detected in turn.

8. A method for the mass spectrometric analysis of a sample comprising the steps of producing ions from said sample, mass analyzing at least those of said ions having masses in the range $M_{min}$ to $M_{max}$ by means of a magnetic sector mass analyzer wherein the magnetic field for the selection of ions is generated by the passage of a magnet current I lying in the range O to $I_{max}$, and controlling said magnet current by means of a digital control signal representing a sequence of integers N each lying within the range $N_{min}$ to $N_{max}$, wherein at a particular instant ions of mass M are selected by generating the integer N according to the expression:

$$N = N_{min} + (N_{max} - N_{min})\frac{\ln(M/M_{min})}{\ln(M_{max}/M_{min})}$$

and the magnet current I is given by the expression:

$$I = I_{max}\left[\frac{M_{min}}{M_{max}}\right]^{\frac{1}{2}} \exp\left[\frac{(N - N_{min})}{2(N_{max} - N_{min})}\ln(M_{max}/M_{min})\right].$$

9. A method for the mass spectrometric analysis of a sample comprising the steps of producing ions from said sample, mass analyzing at least those of said ions having masses in the range $M_{min}$ to $M_{max}$ by means of a magnetic sector mass analyzer wherein the magnetic field for the selection of ions is generated by the passage of a magnet current I lying in the range O to $I_{max}$, controlling said magnet current by means of a first digital control signal representing a sequence of integers N each lying within the range $N_{min}$ to $N_{max}$, generating a second digital control signal representative of a sequence of integers $N_2$ which are exponentially related to the integers N by the expression $N_2 \alpha f(N)/N$, where f(N) is an exponential function of N1; transmitting the first digital control signal to a first digital to analogue conversion means for generating a first voltage signal $V_1$ in the range $V_{1,min}$ to $V_{1,max}$ proportionally to the sequence of integers N; transmitting to a second digital to analogue conversion means the second digital control signal and the signal $V_1$ as a reference voltage, generating from said second digital to analogue conversion means an output voltage signal $V_{DAC2}$ proportionally to $V_1$ and to the second sequence of integers $N_2$, deriving a second voltage signal $V_2$ proportionally to $V_{DAC2}$, and generating said magnet current proportionally to $V_2$, wherein at a particular instant ions of mass M are selected by generating the integer N according to the expression:

$$N = N_{min} + (N_{max} - N_{min})\frac{\ln(M/M_{min})}{\ln(M_{max}/M_{min})}.$$

10. A method as claimed in claim 9 wherein said integers $N_2$ are related to said integers N by the expression:

$$N_2 = \frac{N_{2,max}\, V_{2,max}}{k\,N}\left[\frac{M_{min}}{M_{max}}\right]^{\frac{1}{2}}\left[\exp\left[\frac{\ln(M_{max}/M_{min})\, k\, N}{2\, V_{1,max}} - 1\right]\right]$$

wherein k is a constant defined bY $V_1 = kN$.

11. A mass spectrometer for the analysis of a sample comprising means for producing ions from said sample, a magnetic sector for mass analyzing said ions wherein the magnetic field is generated by the passage of a magnet current, and means for generating a digital control signal representative of a sequence of integers N for controlling said current, wherein means are provided for generating said magnet current as an exponential function of said sequence of integers.

12. A mass spectrometer as claimed in claim 11 wherein means are provided for generating at any particular instant an integer N in the range $N_{min}$ to $N_{max}$ to select ions of mass M in a spectrum of masses ranging from $M_{min}$ to $M_{max}$ according the expression:

$$N = N_{min} + (N_{max} - N_{min})\frac{\ln(M/M_{min})}{\ln(M_{max}/M_{min})}.$$

13. A mass spectrometer as claimed in claim 11 wherein said means for generating said magnet current comprises a first digital to analogue converter for receiving said digital control signal and for producing a first electrical signal $V_1$ in the range $V_{1,min}$ to $V_{1,max}$ in response thereto, means for generating a second electrical signal $V_2$ in the range $V_{2,min}$ to $V_{2,max}$ with a magnitude exponentially related to said first electrical signal, and a current source for producing said magnet current with a magnitude substantially proportional to said second electrical signal.

14. A mass spectometer as claimed in claim 13 for analyzing said ions having masses in the range $M_{min}$ to $M_{max}$ wherein said means for generating said second electrical signal comprises means for generating $V_2$ from $V_1$ according to the expression:

$$V_2 = V_{2,max}\left[\frac{M_{min}}{M_{max}}\right]^{\frac{1}{2}} \times 10^{\left[\frac{V_1}{2V_{1,max}} \cdot \frac{ln(M_{max}/M_{min})}{ln(10)}\right]}.$$

15. A mass spectrometer as claimed in claim 11 wherein said means for generating said digital control signal comprises means for generating a first digital control signal representative of a sequence of integers N, means for generating a second digital control signal representative of a second sequence of integers $N_2$ exponentially related to the integers N, and wherein said means for generating said magnet current comprise a first digital-to-analogue converter for receiving the first digital signal and for generating a voltage $V_1$ proportionally thereto, a second digital-to-analogue converter for receiving both the second digital signal and the voltage $V_1$, for generating an output voltage $V_{DAC2}$ which is substantially proportional to both $N_2$ and $V_1$, means for generating a voltage signal $V_2$ proportionally to $V_{DAC2}$, and means for generating said magnet current proportionally to $V_2$.

16. A mass spectrometer as claimed in claim 15 wherein said means for generating said second digital control signal are such that the second integers $N_2$ are given by the expression $$N_2 \; \alpha \; f(N)/N,$$

where f(N) is an exponential function of N.

17. A mass spectrometer as claimed in claim 15 in which said second integers $N_2$ are related to said first integers N by the expression:

$$N_2 = \frac{N_{2,max}\, V_{2,max}}{k\, N}\left[\frac{M_{min}}{M_{max}}\right]^{\frac{1}{2}}\left[\exp\left[\frac{\ln(M_{max}/M_{min})\, k\, N}{2\, V_{1,max}} - 1\right]\right]$$

wherein k is a constant defined by $V_1 = kN$.

* * * * *